US008739539B2

(12) United States Patent
Tecza

(10) Patent No.: US 8,739,539 B2
(45) Date of Patent: Jun. 3, 2014

(54) ALTERNATIVE PARTIAL STEAM ADMISSION ARC FOR REDUCED NOISE GENERATION

(75) Inventor: Joseph A. Tecza, Scio, NY (US)

(73) Assignee: Dresser-Rand Company, Olean, NY (US)

( * ) Notice: Subject to any disclaimer, the term of this patent is extended or adjusted under 35 U.S.C. 154(b) by 372 days.

(21) Appl. No.: 13/290,278

(22) Filed: Nov. 7, 2011

(65) Prior Publication Data

US 2012/0111008 A1 May 10, 2012

Related U.S. Application Data

(60) Provisional application No. 61/411,165, filed on Nov. 8, 2010.

(51) Int. Cl.
*F01K 1/00* (2006.01)
*F01D 1/02* (2006.01)

(52) U.S. Cl.
USPC ..... 60/670; 415/44; 415/194; 415/195; 415/208.2

(58) Field of Classification Search
USPC ..... 60/670; 415/44, 45, 191, 193, 194, 195, 415/208.1, 208.2, 208.4, 209.1, 209.2
See application file for complete search history.

(56) References Cited

U.S. PATENT DOCUMENTS

| | | | | |
|---|---|---|---|---|
| 4,325,670 | A * | 4/1982 | Silvestri, Jr. | 415/1 |
| 4,940,383 | A * | 7/1990 | Silvestri, Jr. | 415/44 |
| 5,080,558 | A * | 1/1992 | Tran | 415/191 |
| 5,927,943 | A * | 7/1999 | Maier | 415/167 |
| 6,402,465 | B1 * | 6/2002 | Maier | 415/159 |

* cited by examiner

*Primary Examiner* — Hoang Nguyen
(74) *Attorney, Agent, or Firm* — Edmonds & Nolte, PC

(57) ABSTRACT

A diaphragm for a steam turbine is disclosed that has at least one arc of admission. The arc of admission has a plurality of nozzles arranged about the circumference of the diaphragm and are configured to eject a working fluid at succeeding rotor blades axially-spaced from the diaphragm. The flow area of the first few nozzle vanes in the arc of admission is gradually increased along the arcuate length of the diaphragm, thereby mitigating the load impulse absorbed by each rotor blade as it enters the arc of admission. The flow area of the last few nozzle vanes in the arc of admission is gradually decreased so that each rotor blade does not suddenly go from full load impulse to zero and thereby contribute to the fatigue of the rotor blade and create unwanted noise.

20 Claims, 10 Drawing Sheets

ALTERNATIVE PARTIAL STEAM ADMISSION ARC FOR REDUCED NOISE GENERATION

This application claims priority to U.S. Provisional Application having Ser. No. 61/411,165, filed Nov. 8, 2010. This priority application is hereby incorporated by reference in its entirety into the present application, to the extent that it is consistent with the present application.

BACKGROUND

The noise generated by working machinery is commonly referred to as the acoustic signature of the machine. Noise often represents wasted useful work that can adversely affect overall machine efficiency. This is especially true of turbomachines, such as steam turbines, where noise is indicative of fluid energy that is not directed into the shaft of the turbomachine, but is instead wasted as fluid noise energy that decreases efficiency. The acoustic signature of a turbomachine can emanate from several fluid dynamic sources, such as, wake cutting, high velocity fluid dynamics, and turbulent flow fields. In order to increase the overall efficiency of the turbomachine, there is a continued effort to discover new and improved ways to direct wasted fluid noise energy to the shaft where it can produce useful work.

During operation of a steam turbine at full load, steam is admitted to the first stage, or "control stage," through a first set of nozzle vanes arranged in a diaphragm. The diaphragm defines a large circumferential arc disposed upstream of the rotor blades of the first stage. In many steam turbines, the diaphragm is divided into a series of "partial arcs" into which the steam is admitted by means of individual throttle valves. The partial arcs are commonly called the "arcs of admission" of the steam turbine. For operation at low or part load, a given arc of admission may be relatively small, for example, a quarter of the full circumferential arc of the diaphragm, or sometimes even less. This segmentation of the diaphragm allows the steam velocity past the nozzle vanes to be equivalent to that at full load operation, for which the rotor blades are specifically designed and where high turbine power and efficiency are critical. Consequently, steam turbine efficiency may be improved at low and intermediate loads.

As each rotor blade enters and exits the arc of admission during low load operation, however, it is subjected to sudden and immediate load impulses created by the working fluid. These load impulses are absorbed by each passing blade and can generate inefficiencies in the form of undesirable noise, such as frequencies at the harmonics of the nozzle passing frequency. Moreover, the load impulses impart bending forces on each blade which can contribute to the fatigue of the blade material and thereby reduce rotor blade life. As a result, rotor blades are often required to be over-designed to make them more robust and therefore strong enough to endure for the useful life of the rotor assembly.

What is needed, therefore, is a method and system configured to reduce or otherwise mitigate the sudden load impulse absorbed by rotor blades as they enter and exit the arc of admission in a steam turbine operating at low load.

SUMMARY

Embodiments of the disclosure may provide an arc of admission for a steam turbine. The arc of admission may include a first end and a second end, and an outer arcuate wall radially-offset from an inner arcuate wall, the inner and outer arcuate walls each extending from the first end to the second end. The arc of admission may also include a plurality of nozzle vanes circumferentially-spaced between the first end and the second end and arranged between the outer and inner arcuate walls, the plurality of nozzle vanes including a first set of nozzle passages disposed at the first end and a second set of nozzle passages disposed at the second end, wherein the first and second sets of nozzle passages define a reduced flow area.

Embodiments of the disclosure may further provide a steam turbine. The steam turbine may include a steam chest fluidly coupled to a plurality of supply pipes regulated by a corresponding plurality of valves, the steam chest being configured to supply a working fluid to the plurality of supply pipes when the corresponding plurality of valves are in an open position. The steam turbine may further include a circular diaphragm fluidly coupled to each supply pipe and having an outer arcuate wall radially-offset from an inner arcuate wall, the diaphragm defining a first arc of admission having a plurality of nozzle vanes arranged between the inner and outer arcuate walls and circumferentially-spaced between a first end and a second end, wherein a first set of nozzle passages adjacent the first end and a second set of nozzle passages adjacent the second end have a reduced height.

Embodiments of the disclosure may further provide a method of reducing sudden load impulses on rotor blades. The method may include injecting a working fluid into an arc of admission having a plurality of nozzle vanes circumferentially-spaced between a first end and a second end, the plurality of nozzle vanes including a first set of nozzle passages disposed at the first end and a second set of nozzle passages disposed at the second end, wherein the first and second sets of nozzle passages have a reduced flow area. The method may further include ejecting the working fluid from the arc of admission and downstream toward rotor blades rotating about a central axis, wherein a load impulse imparted by the working fluid on each rotor blade progressively increases across the first set of nozzle passages and then progressively decreases across the second set of nozzle passages.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
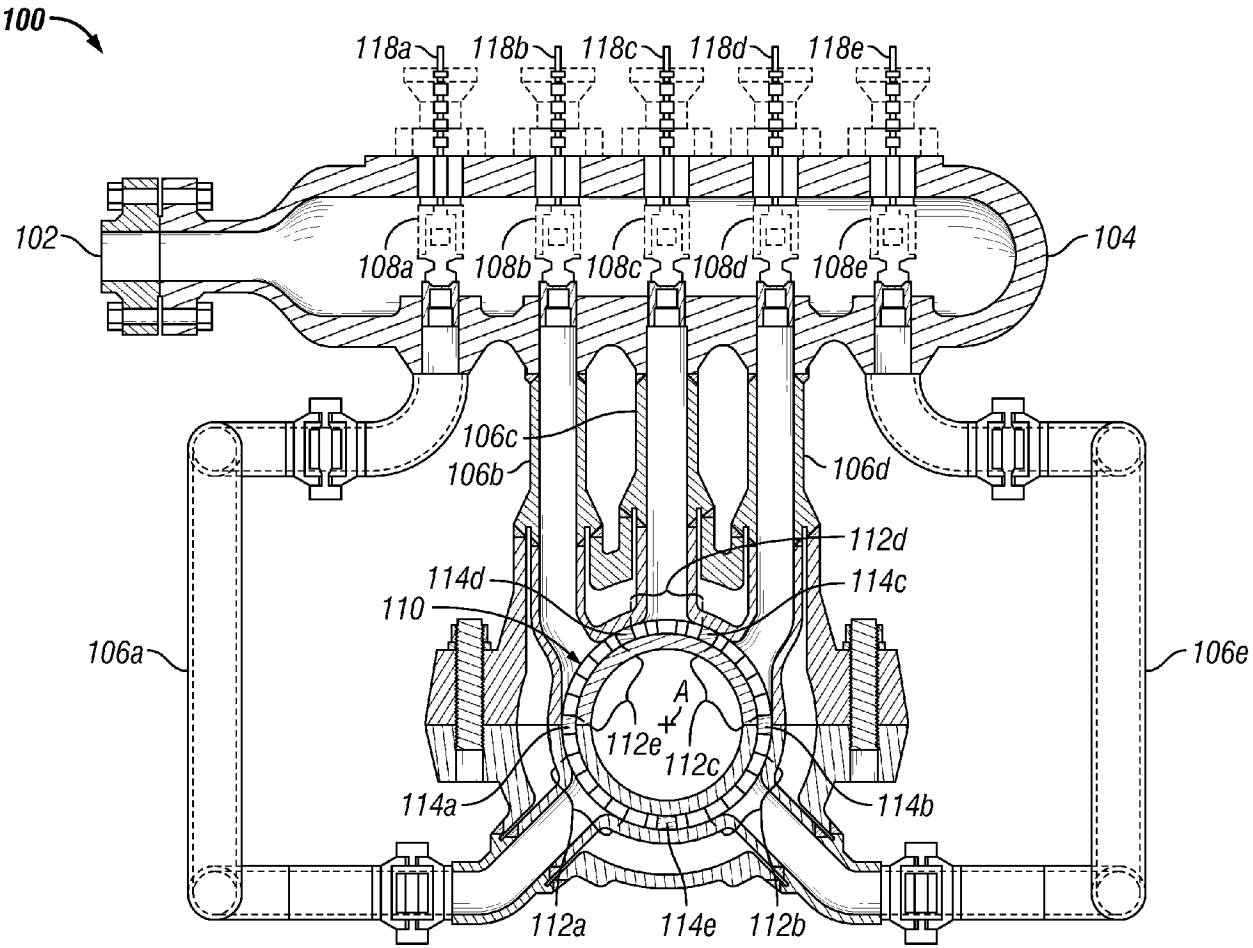
FIG. 1 illustrates a partial cross-sectional view of an exemplary valve system of a turbomachine according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 is a partial cross-sectional view of an exemplary turbomachine 100, according to one or more embodiments disclosed. In at least one embodiment, the turbomachine 100 is a steam turbine, such as a single or multi-stage steam turbine. In other embodiments, however, the turbomachine 100 may be any other type of turbine or expander device, without departing from the disclosure. The turbomachine 100 may include an inlet pipe 102, a steam chest 104, and a plurality of supply pipes, such as supply pipes 106*a-e*. One end of each supply pipe 106*a-e* may be coupled to a corresponding valve 108*a-e*, respectively, while the other end of each supply pipe 106*a-e* fluidly communicates with a diaphragm 110. As illustrated, the diaphragm 110 encompasses a large circumferential arc having a plurality of partial arcs or nozzle bowls 112*a-e* separated from each other by a corresponding number of partitions 114*a-e*. While FIG. 1 shows five supply pipes 106*a-e*, five valves 108*a-e*, and five nozzle bowls 112*a-e*, it is also contemplated that the number of each component may be varied to more or less in order to fit any application.

Each valve 108*a-e* may be actuated to open and closed positions via a corresponding lifting mechanism 118*a-e*. In one embodiment, each lifting mechanism 118*a-e* may include a cam and rod assembly. In other embodiments, each lifting mechanism 118*a-e* may include an electromechanical actuator or any other type of linear actuator. As the lifting mechanism 118*a-e* adjusts the corresponding valve 108*a-e* to an open position, working fluid is then allowed to flow through the corresponding supply pipe 106*a-e* and is subsequently injected into the respective nozzle bowls 112*a-e*.

Each nozzle bowl 112*a-e* may include a plurality of nozzle vanes 116 arranged radially-adjacent each other about the circumference of the diaphragm 110. In one embodiment, the fluid passage of each nozzle vane 116 may be profiled such that the flowpath of a working fluid coursing therethrough becomes substantially straight or flat in the direction of fluid flow. Such exemplary profiled nozzle vanes 116 are described in co-owned U.S. Pat. No. 5,447,413 entitled "Stator Endwall for an Elastic-Fluid Turbine," and co-owned U.S. patent application Ser. No. 12/472,590 entitled "System and Method to Reduce Acoustic Signature Using Profiled Stage Design," the contents of each document are herein incorporated by reference to the extent not inconsistent with the present disclosure. It is also contemplated, however, that the fluid passage of each nozzle vane 116 remains un-profiled.

The diaphragm 110 may further incorporate noise-reducing technology including, but not limited to, noise-reduction arrays or resonator arrays (not shown). Such noise-reduction arrays may be located in the face of the diaphragm 110, or possibly in an adjacent wall of the turbine casing just outside the blading. Suitable noise-reduction arrays may include Helmholtz resonators, such as those described in co-owned U.S. Pat. Nos. 6,550,574; 6,601,672; 6,669,436; and 6,918,740, the contents of which are hereby incorporated by reference to the extent not consistent with the present disclosure.

From the steam chest 104, the supply pipes 106*a-e* are configured to provide a supply of working fluid to one or more of the nozzle bowls 112*a-e*. In one embodiment, the working fluid may include steam. In other embodiments, however, the working fluid may include other fluids, such as air, products of combustion, carbon dioxide, or a process fluid. The partitions 114*a-e* that separate the nozzle bowls 112*a-e* may be configured to prevent the working fluid from being transferred or otherwise conveyed between adjacent nozzle bowls 112*a-e*.

The nozzle bowls 112*a-e* may define at least one arc of admission, or in other words a location about the circumference of the diaphragm 110 where the working fluid may be received due to an open disposition of one or more of the valves 108*a-e*. For example, opening one of the valves 108*a-e* feeds the working fluid through its corresponding supply pipe 106*a-e* and to the nozzle vanes 116 of its corresponding nozzle bowl 112*a-e*. The span of the corresponding nozzle bowl 112*a-e* that receives the working fluid may effectively define a particular arc of admission into the turbomachine 100. In other embodiments, the arc of admission may refer to a set of adjacently-disposed nozzle vanes 116 spanning two or more nozzle bowls 112*a-e* due to the open disposition of two or more valves 108*a-e*. For example, opening two or more valves 108*a-e* may feed the working fluid through their corresponding two or more supply pipes 106*a-e* and to the nozzle vanes 116 of their corresponding two or more nozzle bowls 112*a-e*. The span of the corresponding nozzle bowls 112*a-e* that ultimately receives the working fluid effectively defines another arc of admission into the turbomachine 100.

Since there can be multiple combinations of open and closed valves 108*a-e*, there can likewise be multiple arcs of admission defined for receiving working fluid via the nozzle bowls 112*a-e* at any one time. Sequencing the valves 108*a-e* to dictate the arc of admission may help control the acoustic signature of the turbomachine 100. Valve sequencing is generally described in co-owned U.S. patent application Ser. No. 12/609,997 entitled "Valve Sequencing System and Method for Controlling Turbomachine Acoustic Signature," the contents of which are hereby incorporated by reference to the extent not inconsistent with the disclosure.

In operation of the turbomachine 100 at part or low load, the working fluid is injected through a predetermined arc of admission in the diaphragm 110. As the working fluid exits each nozzle vane 116 encompassing the arc of admission, it acts upon an axially-adjacent downstream rotor blade assembly (not shown). The rotor blade assembly receives the working fluid and converts it into useful work adapted to rotate the assembly about a central axis A of the turbomachine 100. As each rotating rotor blade enters the arc of admission, the working fluid abruptly imparts a load impulse that is immediately absorbed by the rotor blade, thereby forcing the rotor blade to rotate about the central axis A. When the rotor blade exits the arc of admission, the load impulse is abruptly removed and the rotor blade continues rotating with relatively no impulse force acting thereon until re-entering the arc of admission.

As described above, at least one problem that develops as a result of load impulses being suddenly absorbed by the rotor blades and thereafter suddenly removed is the generation of noise that can adversely affect the acoustic signature of the turbomachine 100. Moreover, the abrupt receipt and removal of load impulses convey impulsive bending forces on each rotor blade which ultimately contribute to the fatigue of the rotor blade material, thereby limiting the useful life of each rotor blade.

Figure 2:
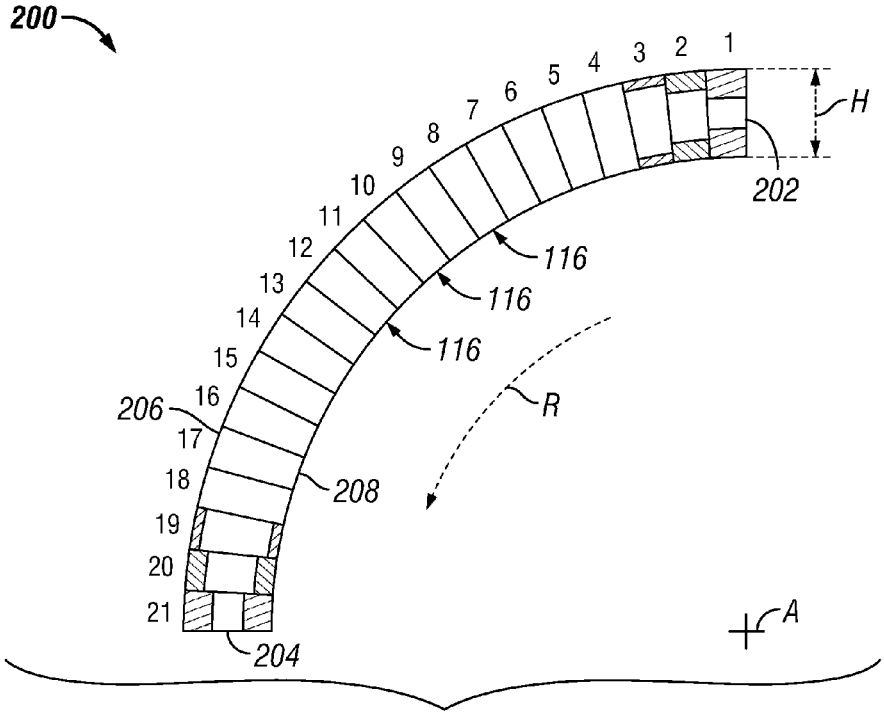
FIG. 2 illustrates a partial arc segment or arc of admission of a diaphragm, according to one or more aspects of the present disclosure.

Referring now to FIG. 2, with continued reference to FIG. 1, illustrated is a partial arc segment or exemplary arc of admission 200 configured to mitigate the adverse effects of the sudden load impulses absorbed by downstream rotating rotor blades (not shown) as each enters the arc of admission 200. Moreover, the arc of admission 200 may also mitigate the adverse effects of suddenly eliminating the load impulse on each downstream rotor blade as it passes out of the arc of admission 200. As illustrated, the arc of admission 200 may be of a finite length that encompasses approximately a 90° revolution about the center axis A of the turbomachine 100. As will be appreciated, the arc of admission 200 may encompasses more or less than a 90° revolution about the center axis A without departing from the scope of the disclosure. During operation, the downstream rotor blades may be adapted to rotate in rotational direction R about the center axis A. In other embodiments, however, the rotational direction R may be reversed.

The arc of admission 200 may include a first end 202 and a second end 204, having an outer arcuate wall 206 and an inner arcuate wall 208 extending therebetween. The arc of admission 200 may further include a plurality of nozzle vanes 116 that define sequentially numbered nozzle passages 1-21 that are circumferentially-spaced and adjacently disposed between the first and second ends 202, 204. Depending on the arcuate length of the arc of admission 200, the total number of nozzle vanes 116 between the first and second ends 202, 204 may increase or decrease without departing from the scope of the disclosure. Each nozzle vane 116 or nozzle passage 1-21 may be designed to provide a specific flow area proportional to the desired load impulse or force imparted on the succeeding rotor blades. The flow area of each nozzle passage 1-21 is partly derived from the relative passage height H of the nozzle vanes 116.

Figure 10A:
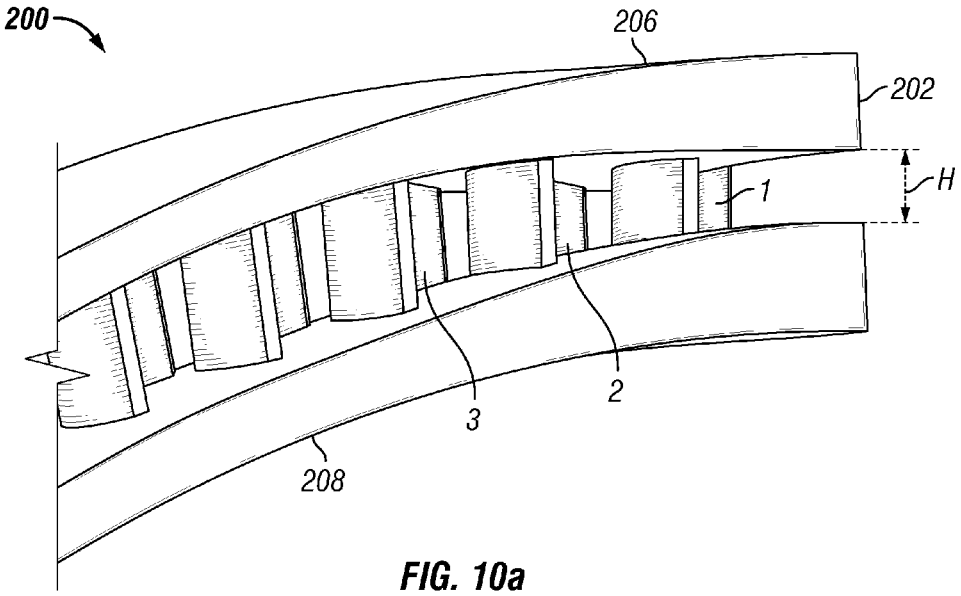
FIGS. 10*a* and 10*b* illustrate cross-sectional views of the first and second ends, respectively, of the arc of admission shown in FIG. 2.
Figure 10B:
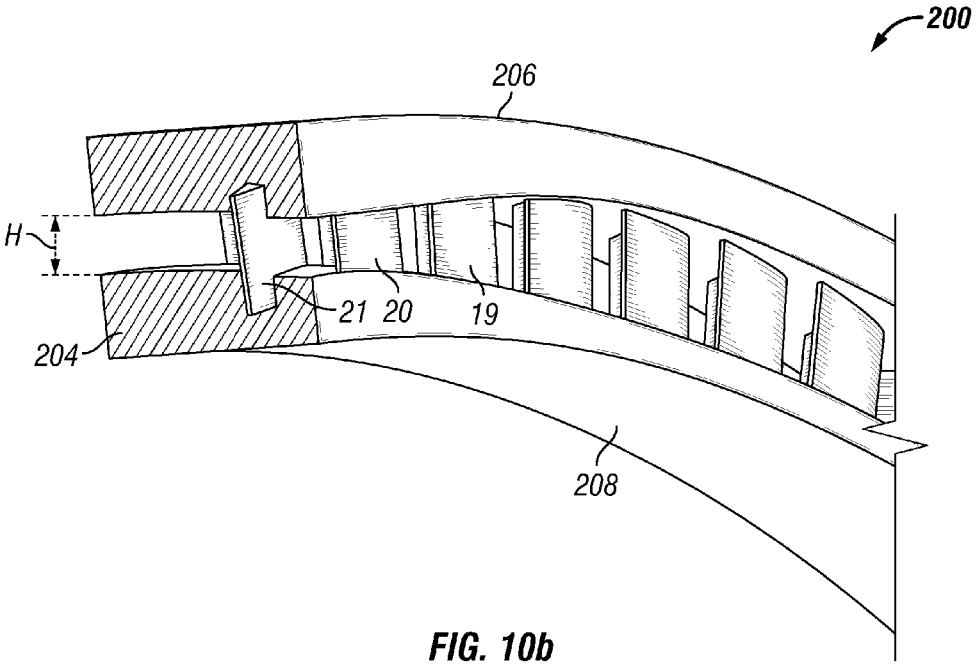

In an embodiment, and as also seen in FIGS. 10*a* and 10*b* discussed below, one or more of the nozzle passages 1-21 disposed at the first and second ends 202, 204 of the arc of admission 200 may have a reduced passage height H, and therefore a reduced flow area. For example, a first set of nozzle passages 1-3 arranged at the first end 202 of the arc of admission 200 may have respective passage heights H that gradually or progressively increase in the rotational direction R, thereby gradually increasing the respective flow areas of each nozzle passage 1-3. Also, a second set of nozzle passages 19-21 arranged at the second end 204 may have respective heights H that gradually or progressively decrease in the rotational direction R, thereby gradually decreasing the respective flow areas of each nozzle passage 19-21. Consequently, the load imparted by the working fluid on a particular blade gradually ramps up at nozzle passages 1-3, is constant at nozzle passages 4-18, and then gradually ramps down at nozzle passages 19-21. In other words, the load impulse imparted by the working fluid on a rotor blade entering and subsequently exiting the arc of admission 200 may be gradually applied and thereafter gradually withdrawn, thereby circumventing the unfavorable consequences of an abruptly-applied and abruptly-removed load impulse.

The circumferential profile of the actual passage of each of the reduced-height H nozzle passages 1-3 and 19-21 may be the same as for the remaining nozzle vanes 116 (i.e., nozzle passages 4-18), but the respective height H of each passage is reduced. In the embodiment shown, this height reduction may be realized by moving the outer wall 206 of each nozzle passage 1-3 and 19-21 radially-inward, and the inner wall 208 of each nozzle passage 1-3 and 19-21 radially-outward. Such a modification reduces the flow area equally across the axial length of the passage of each nozzle passage 1-3 and 19-21, so that the area reduction as seen by the working fluid flowing therethrough and the two-dimensional flow passage geometry remains the same. Consequently, the expansion ratio and velocity vector of the working fluid exiting the reduced-height H nozzle passages 1-3 and 19-21 may be essentially identical to that of the other nozzle vanes 116 (i.e., nozzle passages 4-18), but the working fluid acts on a downstream rotor blade over a reduced area. As can be appreciated, this allows the "velocity triangle" to approximately remain the same for all the openings of the nozzle vanes 116 (specifically the angle at which the working fluid approaches the leading edge of the rotor blade), thereby preserving stage efficiency.

It will be appreciated that the number of nozzle vanes 116 at either end 202, 204 of the arc of admission 200 having a reduced height H, as described above, may be varied as desired. While FIGS. 2 and 10*a-b* show a set of three nozzle vanes 116 at each end 202, 204 affected by this modification (i.e., first set of nozzle passages 1-3 and second set of nozzle passages 19-21), more or less nozzle vanes 116 having reduced heights H may be employed, without departing from the scope of the disclosure. For instance, it is contemplated to have one nozzle vane 116 at each end 202, 204 with a reduced flow area, or perhaps two or more than three with flow areas that gradually increase or decrease.

Figure 3:
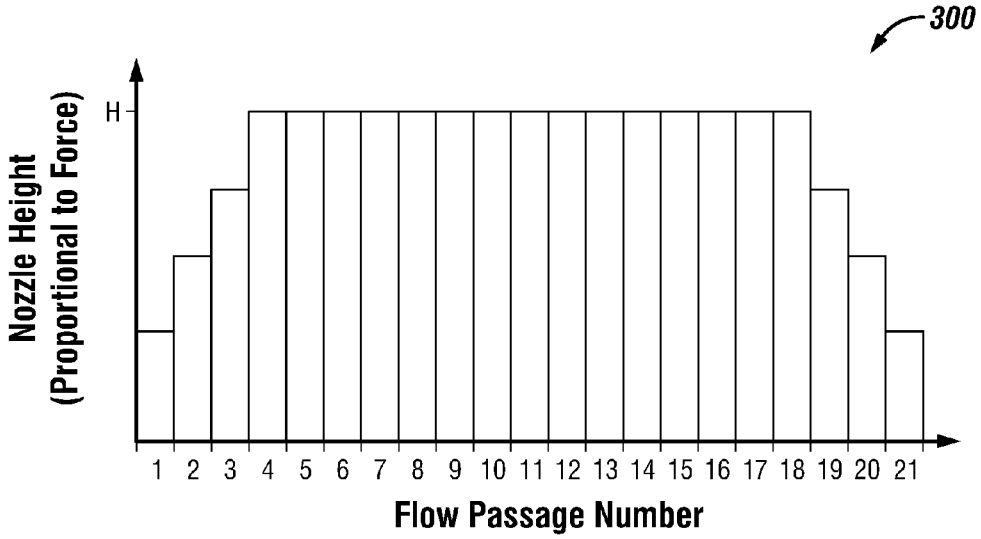
FIG. 3 illustrates a graph depicting the forces exerted by the nozzles of the arc of admission of FIG. 2.

Referring to FIG. 3, illustrated is a chart 300 indicative of the flow area for each nozzle 1-21 of the exemplary arc of admission 200 shown in FIG. 2. The Y-axis provides the height of each nozzle, proportional to the force provided by each nozzle. The X-axis indicates which of the nozzle passages 1-21 is reported. As illustrated in the chart 300, nozzle passages 1-3 and 19-21 have a reduced height, and therefore provide a proportionally-reduced force imparted to downstream rotor blades.

As will be appreciated, reducing the height and flow area of the first set of nozzle passages 1-3 and the second set of nozzle passages 19-21 arranged at the ends 202, 204 of the arc of admission 200 also reduces the overall flow area for the arc of admission 200 as a whole. Consequently, the height H of the remaining nozzle passages 4-18 may have to be increased slightly to compensate so as to achieve the correct flow area designed for the turbomachine 200. In at least one embodiment, this may also require a corresponding increase in the height of the succeeding rotor blades. Accordingly, the general increase in the height of the nozzle passages 4-18 may serve to supply the same net flow area as an arc of admission that omits reduced flow areas of nozzle passages 1-3 and 19-21, therefore yielding the same potential for power output.

Figure 4A:
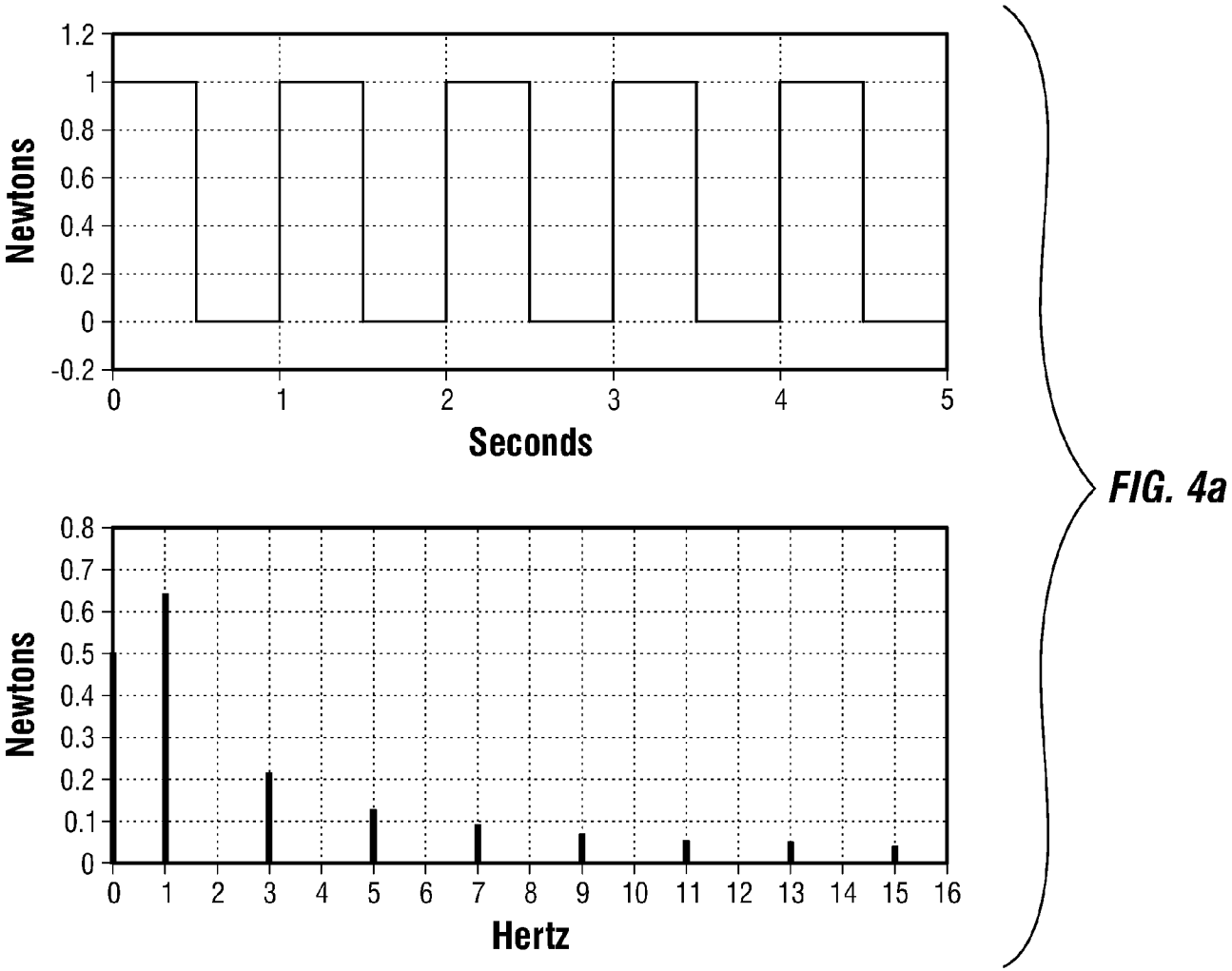
FIGS. 4*a* and 4*b* illustrate graphs showing a comparative analysis of force from a conventional arc of admission modeled as a square wave versus an idealized behavior sought for the arc of admission disclosed herein according to one or more aspects of the present disclosure.
Figure 4B:
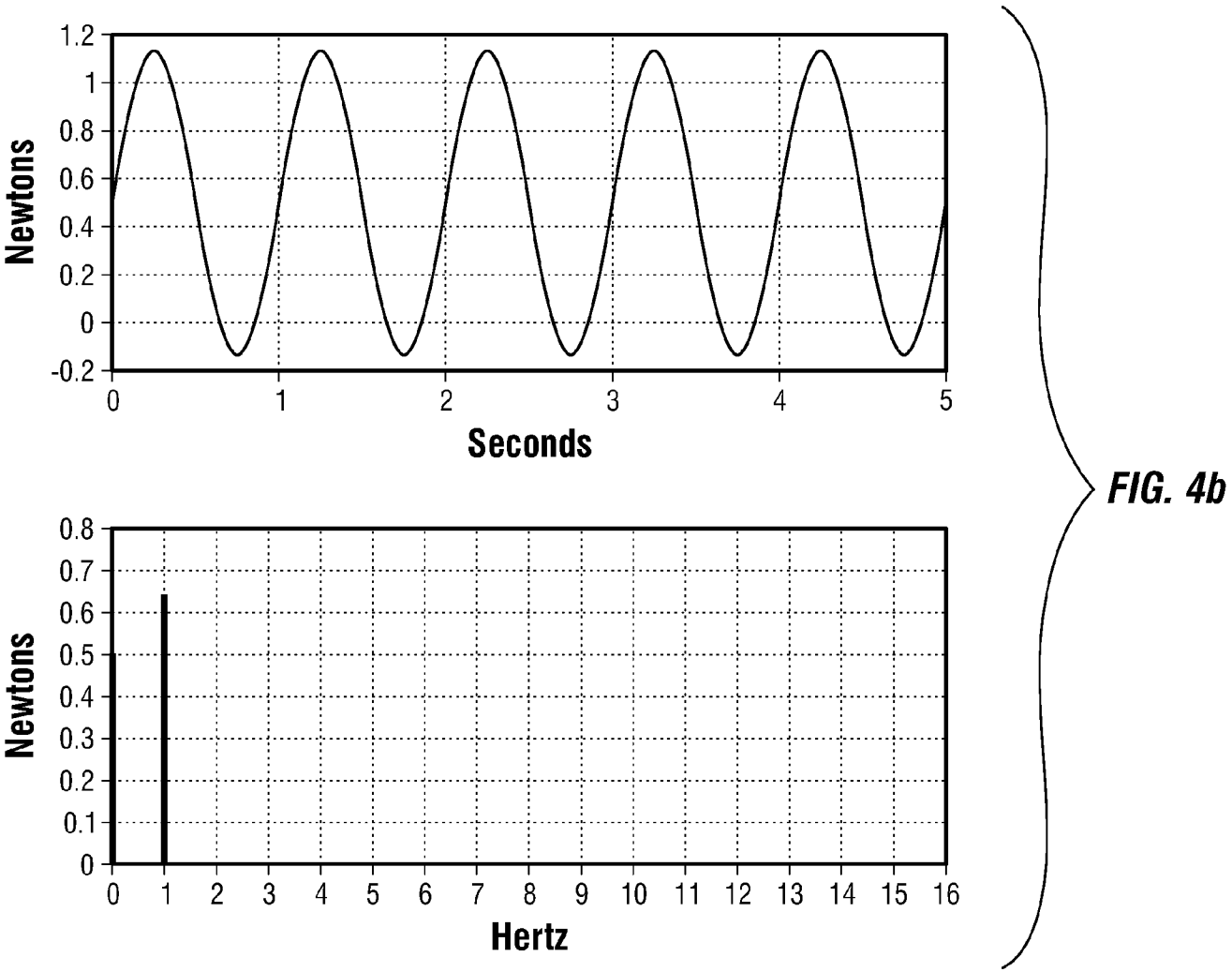

Referring to FIGS. 4*a* and 4*b*, illustrated is a waveform comparison indicating certain advantages gained by implementing reduced-height nozzles at the first and second ends 202, 204 of an arc of admission 200 (FIG. 2), as opposed to conventional arcs of admission. At least one principle behind the embodiments of reduced-height nozzles is to reduce the potential for noise generation and potent stresses on downstream blades by making the force on a given blade appear more like a sine wave than a square wave in character. For instance, FIG. 4*a* illustrates the "on-off" character of the force for a conventional nozzle arc of admission omitting reduced-height nozzles. As illustrated in the upper portion of FIG. 4*a*, the conventional nozzles provide a rough approximation of a square wave in time. The load is at one point zero but rises instantaneously to full value. A spectrum derived from a Fourier analysis of this square wave is shown in the lower portion of FIG. 4*a*. The square wave essentially consists of a peak at the fundamental nozzle passing frequency, accompanied by many smaller peaks at odd harmonics of that frequency (e.g., 1, 3, 5, 7, etc.). Vibration is generated from all of these peaks and would be perceived as noise at those discrete frequencies.

By contrast, FIG. 4*b* illustrates a corresponding sinusoidal waveform. As shown, tapering the rise and fall of the amplitude at the ends of the square wave (FIG. 4*a*) approximates the behavior of the sine wave in FIG. 4*b*, which has frequency content at the fundamental frequency only, and little or no energy at the succeeding harmonic frequencies. This is at least one of the characteristic behaviors that the embodiments disclosed herein seek to emulate, i.e., minimizing noise at the harmonic frequencies. What remaining noise there is may be restricted to a narrow frequency band which may be eliminated or otherwise reduced through other mitigation means such as a Helmholtz resonator, as discussed above.

An additional benefit of implementing the reduced-height nozzles is the reduction in amplitude of potential "load spikes" that are commonly created from nozzles arranged at the first and second ends 202, 204 of the arc of admission 200 (FIG. 2). In some applications such load spikes impart a force that is approximately 130% of the level imparted by the other nozzles in the arc of admission, thereby impacting the downstream blades at an increased intensity. In embodiments implementing reduced-height nozzles, however, the load spikes are suppressed and blade loads are summarily reduced.

Figure 5A:
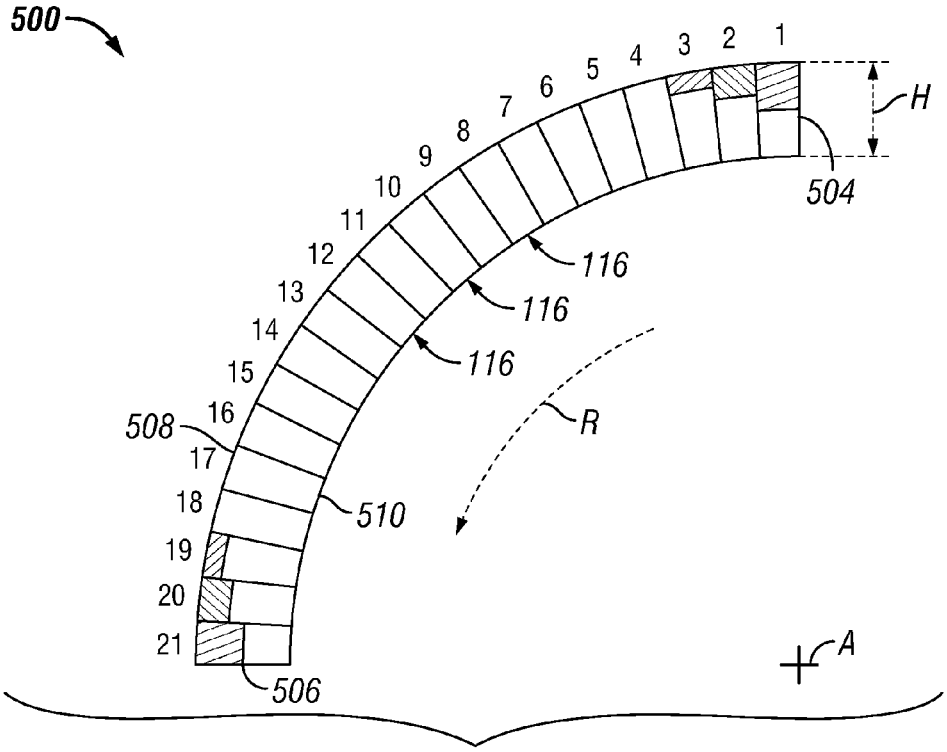
FIGS. 5*a* and 5*b* illustrate different embodiments of the arc of admission, according to one or more aspects of the present disclosure.
Figure 5B:
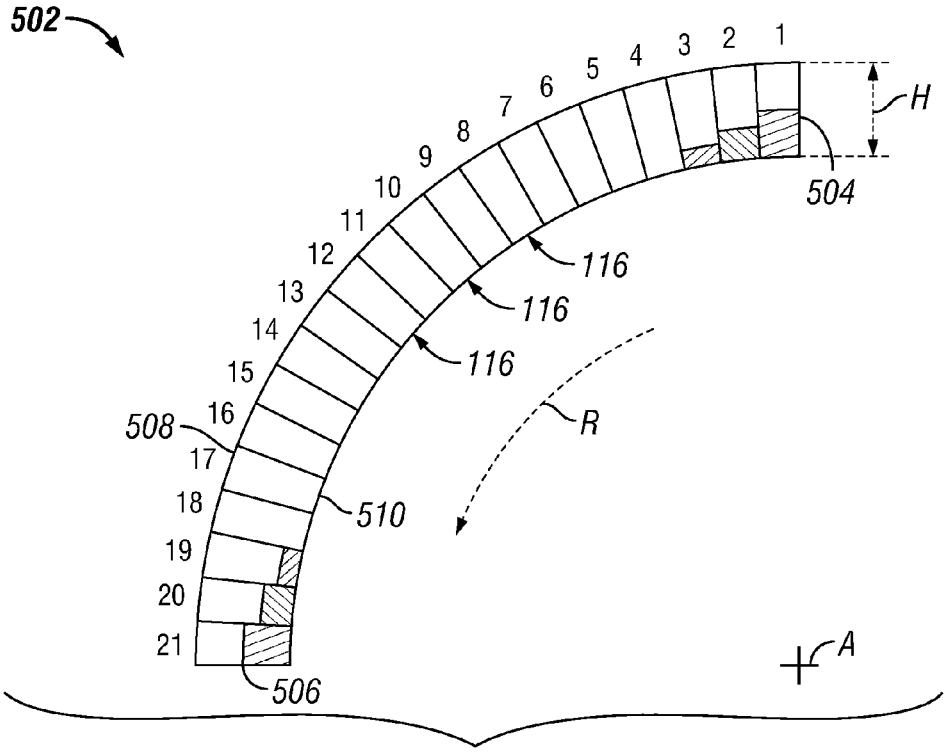

Referring to FIGS. 5*a* and 5*b*, illustrated are other exemplary embodiments of an arc of admission 500, 502, respectively, configured to mitigate the adverse effects of the sudden load impulses absorbed by downstream rotor blades and suddenly eliminating the load impulse on each rotor blade. The arcs of admission 500, 502 may be substantially similar to the arc of admission described in FIG. 2 above. Each exemplary arc of admission 500, 502 may include a first end 504 and a second end 506, having a plurality of nozzle vanes 116 (sequentially numbered as nozzle passages 1-21) circumferentially-spaced therebetween. The flow area of each nozzle vane 116 is partly derived from the relative passage height H of each nozzle vane 116.

In an embodiment, one or more of the nozzle vanes 116 disposed at the first and second ends 504, 506 of the respective arcs of admission 500, 502 may have a reduced passage height H, and therefore a reduced flow area. As shown, nozzle passages 1-3 arranged at the first end 504 of the arcs of admission 500, 502 may have respective heights H that gradually increase in the rotational direction R, while nozzle passages 19-21 arranged at the second end 506 may have respective heights H that gradually decrease in the rotational direction R. The height reduction shown in FIG. 5*a* may be realized by moving the outer wall 508 of each nozzle passage 1-3 and 19-21 radially-inward. On the other hand, the height reduction shown in FIG. 5*b* may be realized by moving the inner wall 508 of each nozzle passage 1-3 and 19-21 radially-outward. Accordingly, the load imparted by the working fluid on a particular blade gradually ramps up at nozzle passages 1-3, is constant at nozzle passages 4-18, and then gradually ramps down at nozzle passages 19-21.

It will be appreciated that implementing reduced-height nozzle vanes 116 on only one wall (e.g., 504 or 506) of the arc of admission 500, 502 as opposed to both walls (e.g., 206 and 208, as shown in FIG. 2), may save on manufacturing costs and time. Moreover, at least one advantage to the embodiment shown in FIG. 5*a* is that the working fluid may be ejected from the arc of admission 500 in a direction toward the bottom of the succeeding rotor blades where the rotor blade is best designed to handle incipient load impulses and stresses.

Figure 6:
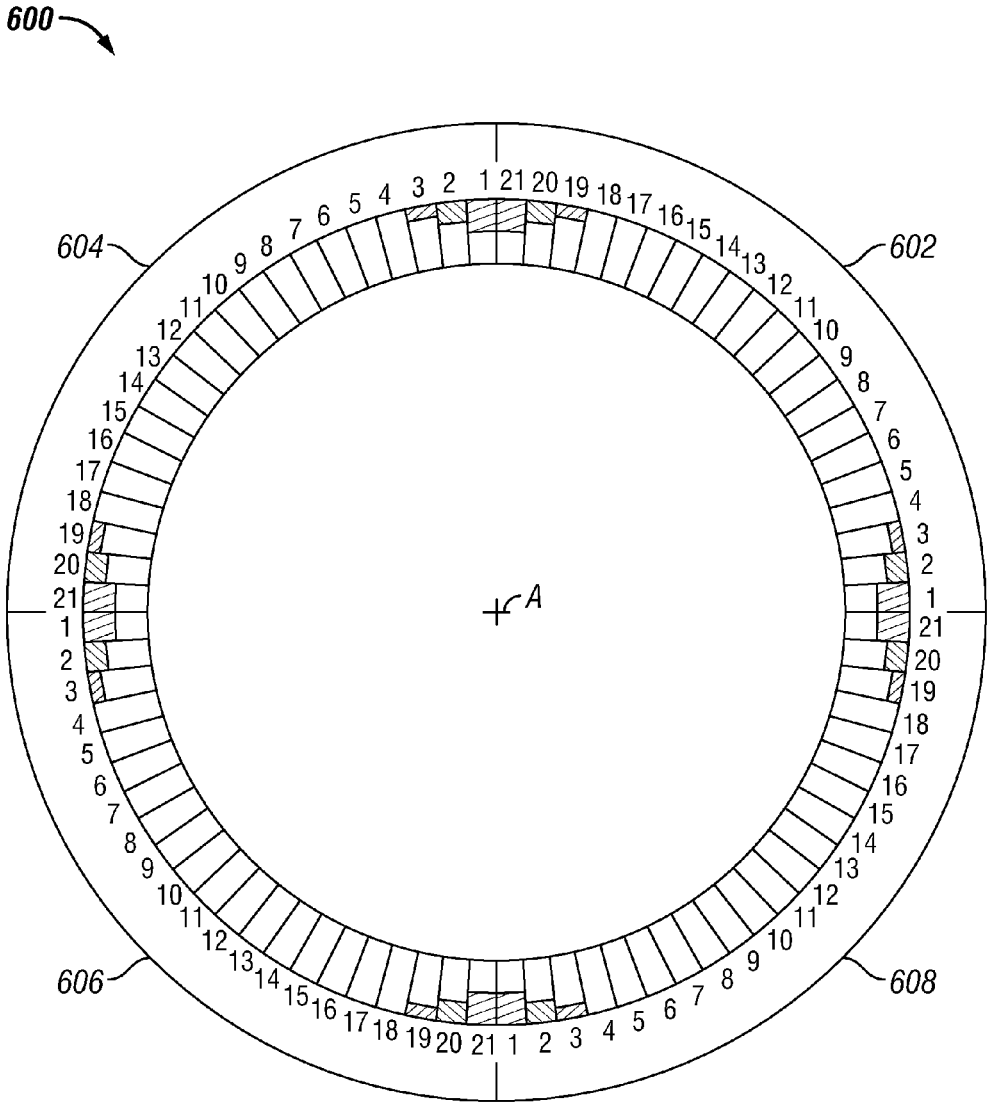
FIG. 6 illustrates an exemplary diaphragm including multiple arcs of admission, according to one or more aspects of the present disclosure.
Figure 7:
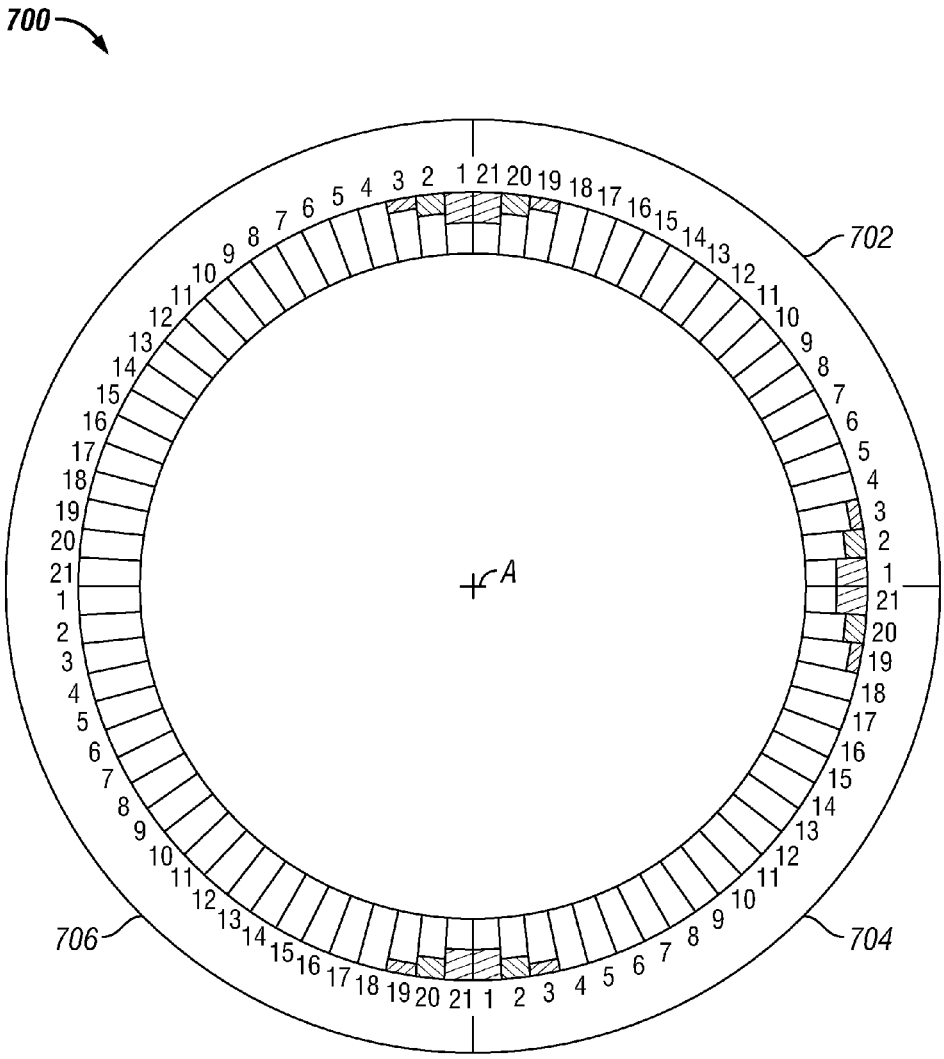
FIG. 7 illustrates another exemplary diaphragm including multiple arcs of admission, according to one or more aspects of the present disclosure.

Referring now to FIG. 6, illustrated is an exemplary diaphragm 600 having four exemplary arcs of admission 602, 604, 606, and 608 arranged in a back-to-back configuration. As shown, each arc of admission 602-608 is substantially similar to the arc of admission 500 described with reference to FIG. 5 above. The back-to-back configuration of the diaphragm 600 allows for a smooth transition from one arc of admission to the next, thereby preserving continuity of working fluid flow. Other embodiments may include more or less arcs of admission, where the arcs of admission do not operate individually in partial arc mode. For example, FIG. 7 illustrates another exemplary diaphragm 700 having at least three arcs of admission 702, 704, and 706 arranged in a back-to-back configuration. Again, each arc of admission 702, 704, 706 may be substantially similar to the arc of admission 500 described above. As illustrated, however, the third arc of admission 706 may be an extended arc or an arc of admission that is larger than the first two arcs of admission 702 and 704. In other embodiments, the third arc of admission 706 may otherwise include two arcs of admission having tapered or reduced-height nozzle vanes 116 (FIG. 2) arranged only at one end as described herein.

Figure 8:
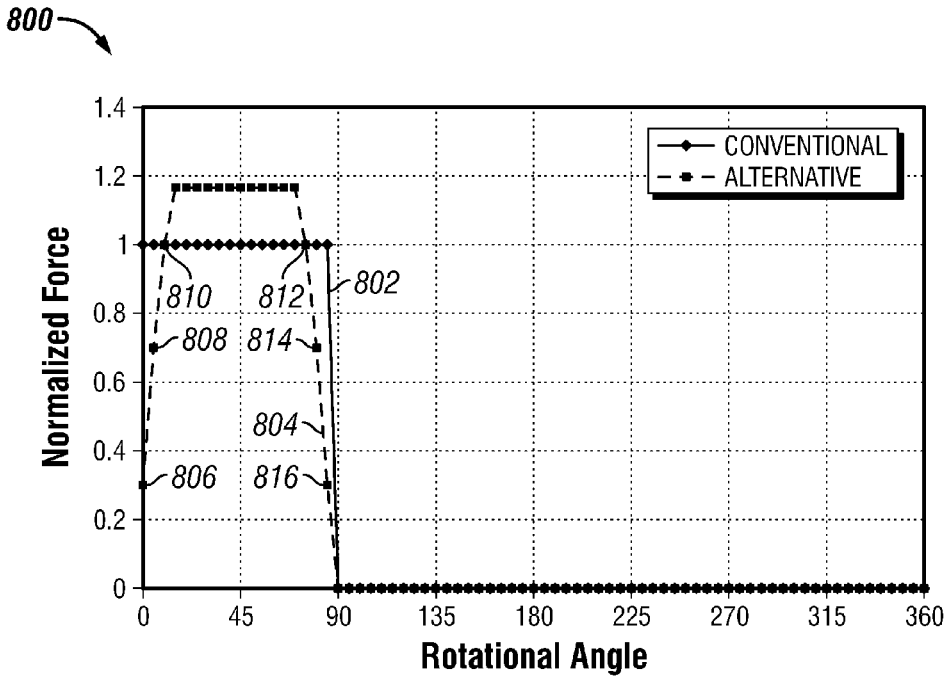
FIG. 8 is a graph depicting comparative results of a Fourier analysis of a conventional diaphragm versus a presently disclosed diaphragm.

Referring to FIG. 8, illustrated is a graph 800 depicting comparative results of Fourier analyses calculated for a conventional diaphragm having a conventional arc of admission 802 versus a diaphragm having an arc of admission 804 with tapered or reduced-height nozzles at each end, as generally disclosed herein. The graph 800 indicates the normalized force (proportional to nozzle size) exerted by each nozzle, where each plotted point represents a single nozzle in the arc or admission 802, 804 disposed in a full 360° diaphragm (Y-axis). An arbitrary choice was made to set the normalized force to 1.0 for the conventional nozzle passage. Height reductions for the three nozzles at either end (e.g., reference numerals 806, 808, 810 and 812, 814, 816) of the presently disclosed arc of admission 804 also were selected arbitrarily to result in a gradual load increase/decrease proportional to the rotational angle. As illustrated, the forces from the remaining nozzles of the arc of admission 804 are increased to provide equivalent flow area, as described above.

Figure 9:
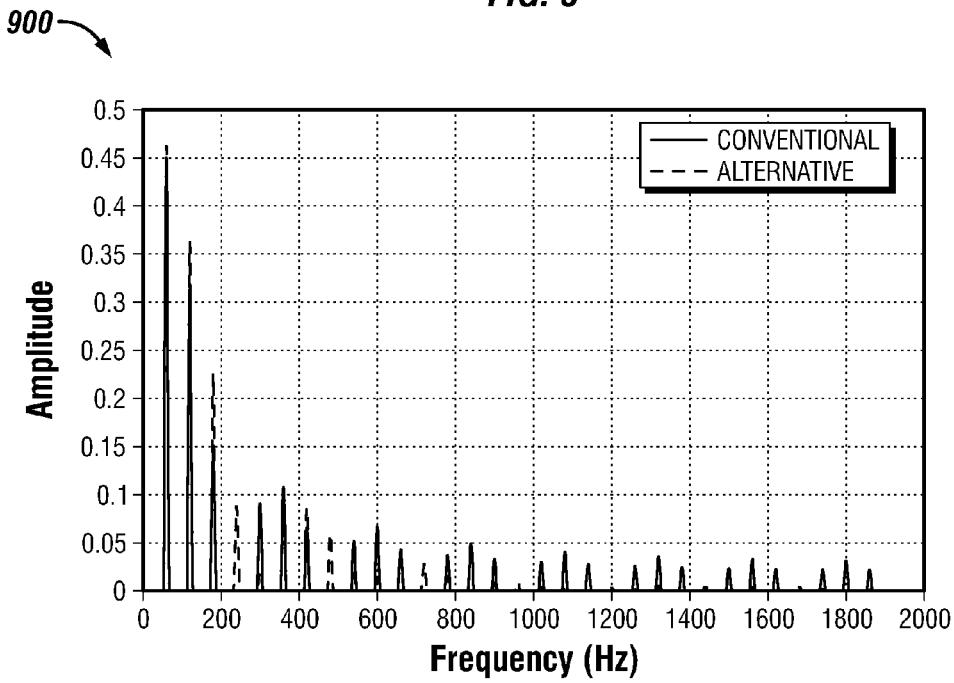
FIG. 9 is another graph depicting the results of a fast Fourier transform numerical comparative analysis between a conventional arc of admission versus a presently disclosed arc of admission.

FIG. 9 is another graph 900 indicating the results of a fast Fourier transform numerical comparative analysis between a conventional arc of admission versus an arc of admission having tapered or reduced-height nozzles at each end, as generally described herein. The solid lines shown in FIG. 9 represent the results from the conventional arc of admission, while the dashed lines are indicative of a presently disclosed arc of admission. For ease of Fourier transform calculation, the numerical analysis used sixteen nozzle vanes per arc of admission. Moreover, the calculation spanned a frequency of 2000 Hz, and assumed a speed of 3600 rpm for the downstream rotating blades. As illustrated, the response for the fundamental frequency is about the same for each arc of admission, but the presently disclosed arc of admission shows a somewhat higher response for the first two or three frequency components or harmonics and then is generally lower at frequencies ranging above that. In contrast, the conventional arc of admission continues to emit noise at large amplitudes across the full 2000 Hz frequency range.

Referring now to FIGS. 10*a* and 10*b*, illustrated are cross-sectional views of the first end 202 and the second end 204, respectively, of the exemplary arc of admission 200 described above with reference to FIG. 2. Accordingly, FIGS. 10*a* and 10*b* may be best understood with reference to FIG. 2. As shown in FIGS. 10*a* and 10*b*, the outer and inner walls 206, 208 gradually converge toward each near the ends 202, 204 of the arc of admission 200, thereby providing a smaller flow area for the working fluid. Accordingly, nozzle passages 1-3 in FIG. 10*a* and nozzle passages 19-21 in FIG. 10*b* have heights that are reduced, thereby reducing their respective flow areas.

Figure 11:
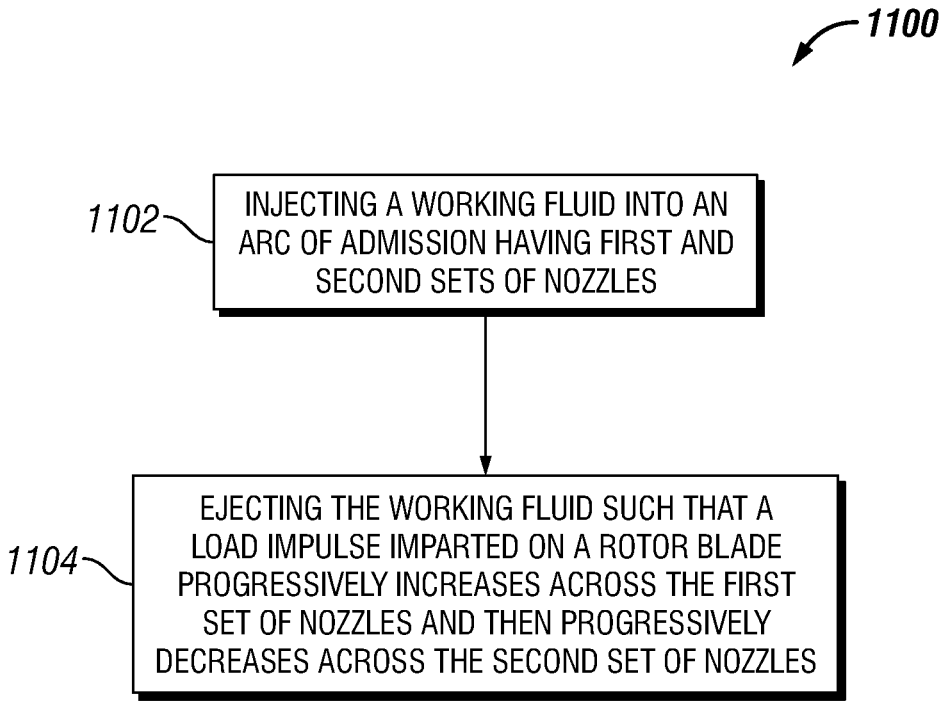
FIG. 11 illustrates a schematic of a method for reducing sudden load impulses on rotor blades, according to one or more embodiments disclosed.

Referring now to FIG. 11, illustrated is a schematic method 1100 of reducing sudden load impulses on rotor blades. The method 1100 may include injecting a working fluid into an arc of admission having first and second sets of nozzles, as at 1102. The arc of admission may have a plurality of nozzle vanes circumferentially-spaced between a first end and a second end of the arc of admission. The plurality of nozzle vanes may include the first set of nozzle vanes disposed at the first end and the second set of nozzle vanes disposed at the second end, where the first and second sets of nozzle vanes have nozzle passages with a reduced flow area.

The method 1100 may also include ejecting the working fluid from the arc of admission such that a load impulse imparted on downstream rotor blades progressively increases across the first set of nozzles and then progressively decreases across the second set of nozzles, as at 1104. In other words, as the downstream rotor blades rotating about a central axis pass through the arc of admission, the load impulse imparted by the first set of nozzle vanes may be configured to progressively or gradually ramp up. As the rotor blades leave the arc of admission, the load impulse imparted by the second set of nozzles gradually ramps down. As described herein, this is to prevent abrupt or sudden load impulses being applied to and removed from the rotor blades, which can cause unwanted noise and bending fatigue.

It will be appreciated by those skilled in the art that the present disclosure may be equally applied to several other types of steam turbines, such as single-stage turbines having cylindrical nozzles (i.e., venturi-type nozzles) arranged in the diaphragm instead of nozzle vanes. For example, it would be equally possible to reduce the diameter of the first and last few cylindrical nozzles in an arc of admission to mitigate the load impulse on any succeeding rotor blades.

Several advantages are provided by the present disclosure. For instance, tapered nozzles at the ends of an arc of admission keep part load efficiency from partial arc admission. Also, it may reduce the noise generated by the "on-off" character and square-wave effect of a conventional nozzle segment. Lastly, the tapered nozzles at the ends of an arc of admission keep the velocity at the ends of the arc of admission the same as the nozzles disposed therebetween, thereby preserving the velocity triangle relationship from nozzle to rotor blade.

It should be noted that the term "about," as used herein, refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" expressly includes "exactly," consistent with the discussion above regarding angular configurations.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. An arc of admission for a steam turbine, comprising:

an outer arcuate wall radially-offset from an inner arcuate wall, the inner and outer arcuate walls each extending from a first end to a second end; and a plurality of nozzle vanes circumferentially-spaced between the first end and the second end and arranged between the outer and inner arcuate walls, the plurality of nozzle vanes including a first set of nozzle passages disposed at the first end and a second set of nozzle passages disposed at the second end, wherein the first and second sets of nozzle passages define a flow area that is reduced.

2. The arc of admission of claim 1, wherein the inner and outer arcuate walls extend circumferentially about 90 degrees.

3. The arc of admission of claim 1, wherein the flow area of each adjacent nozzle passage in the first set gradually increases from the first end toward the second end.

4. The arc of admission of claim 3, wherein the first set includes three nozzle passages.

5. The arc of admission of claim 1, wherein the flow area of each adjacent nozzle passage in the second set gradually increases from the second end toward the first end.

6. The arc of admission of claim 5, wherein the second set includes three nozzle passages.

7. The arc of admission of claim 1, wherein the flow area of each nozzle passage is reduced by decreasing a height of the first and second sets of nozzle passages.

8. The arc of admission of claim 7, wherein the height of the first and second sets of nozzle passages is reduced by moving the outer arcuate wall radially-inward.

9. The arc of admission of claim 7, wherein the height of the first and second sets of nozzle passages is reduced by moving the inner arcuate wall radially-outward.

10. The arc of admission of claim 7, wherein the height of the first and second sets of nozzle passages is reduced by moving the outer arcuate wall radially-inward and the inner arcuate wall radially-outward.

11. A steam turbine, comprising:

a steam chest fluidly coupled to a plurality of supply pipes regulated by a corresponding plurality of valves, the steam chest being configured to supply a working fluid to the plurality of supply pipes when the corresponding plurality of valves are in an open position; and a diaphragm fluidly coupled to each supply pipe and having an outer arcuate wall radially-offset from an inner arcuate wall, the diaphragm defining a first arc of admission having a plurality of nozzle vanes arranged between the inner and outer arcuate walls and circumferentially-spaced between a first end and a second end, wherein a first set of nozzle passages adjacent the first end and a second set of nozzle passages adjacent the second end have a height that is reduced.

12. The steam turbine of claim 11, wherein the height of each adjacent nozzle passage in the first set of nozzle passages gradually increases from the first end toward the second end.

13. The steam turbine of claim 12, wherein the height of each adjacent nozzle passage in the second set of nozzle passages gradually increases from the second end toward the first end.

14. The steam turbine of claim 13, wherein the circular diaphragm further defines a second arc of admission having a first end, a second end, and a third set of nozzle passages arranged at the first end of the second arc of admission, wherein the third set of nozzle passages has a height that is reduced.

15. The steam turbine of claim 14, wherein the third set of nozzle passages is arranged circumferentially-adjacent the second set of nozzle passages of the first arc of admission, the height of each adjacent nozzle passage in the third set of nozzle passages gradually increasing from the first end of the second arc of admission toward the second end of the second arc of admission.

16. The steam turbine of claim 11, wherein the height of the first and second sets of nozzle passages is reduced by moving the outer arcuate wall radially-inward.

17. The steam turbine of claim 11, wherein the height of the first and second sets of nozzle passages is reduced by moving the inner arcuate wall radially-outward.

18. The steam turbine of claim 11, wherein the height of the first and second sets of nozzle passages is reduced by moving the outer arcuate wall radially-inward and the inner arcuate wall radially-outward.

19. A method of reducing sudden load impulses on rotor blades, comprising:

injecting a working fluid into an arc of admission having a plurality of nozzle vanes circumferentially-spaced between a first end and a second end, the plurality of nozzle vanes including a first set of nozzle passages disposed at the first end and a second set of nozzle passages disposed at the second end, wherein the first and second sets of nozzle passages have a reduced flow area; and ejecting the working fluid from the arc of admission and downstream toward rotor blades rotating about a central axis, wherein a load impulse imparted by the working fluid on each rotor blade progressively increases across the first set of nozzle passages and then progressively decreases across the second set of nozzle passages.

20. The method of claim 19, wherein the working fluid is steam.

* * * * *